US010479092B2

(12) United States Patent
Ochiai

(10) Patent No.: US 10,479,092 B2
(45) Date of Patent: Nov. 19, 2019

(54) WASTE LIQUID CONTAINER AND LIQUID EJECTING APPARATUS

(71) Applicant: SEIKO EPSON CORPORATION, Tokyo (JP)

(72) Inventor: Toshiyuki Ochiai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/991,724

(22) Filed: May 29, 2018

(65) Prior Publication Data

US 2018/0345674 A1 Dec. 6, 2018

(30) Foreign Application Priority Data

May 31, 2017 (JP) ..... 2017-107704

(51) Int. Cl.
*B41J 2/17* (2006.01)
*B41J 29/13* (2006.01)

(52) U.S. Cl.
CPC ..... *B41J 2/1721* (2013.01); *B41J 29/13* (2013.01); *B41J 2002/1728* (2013.01)

(58) Field of Classification Search
CPC .. B41J 2/1721; B41J 29/13; B41J 2002/1728; B41J 2002/1856
See application file for complete search history.

(56) References Cited

U.S. PATENT DOCUMENTS 9,132,644 B2 * 9/2015 Harada ..... B41J 2/1721
2012/0236074 A1 9/2012 Harada et al.
2017/0203575 A1 7/2017 Shimazu

FOREIGN PATENT DOCUMENTS

JP 2012-196799 A 10/2012
JP 2017-124541 A 7/2017

* cited by examiner

*Primary Examiner* — Geoffrey S Mruk
(74) *Attorney, Agent, or Firm* — Workman Nydegger

(57) ABSTRACT

A waste liquid container configured to be attachably and detachably mounted in a mounting portion including an apparatus-side connection terminal includes a first container portion including a waste liquid introduction portion, the waste liquid introduction portion being configured to enable the waste liquid discharged from the discharge portion to be introduced; a second container portion disposed below the first container portion in a vertical direction and communicating with the first container portion in the state in which the waste liquid container is mounted in the mounting portion; and a container-side connection terminal electrically connected to the apparatus-side connection terminal. Further, in a plan view from above, the second container portion is formed so as to be larger than the first container portion, and in the second container portion, the container-side connection terminal is disposed at a position not overlapping with the first container portion in the vertical direction.

6 Claims, 7 Drawing Sheets

WASTE LIQUID CONTAINER AND LIQUID EJECTING APPARATUS

BACKGROUND

1. Technical Field

The present invention relates to a waste liquid container and a liquid ejecting apparatus.

2. Related Art

Among liquid ejecting apparatuses that perform printing by ejecting liquid onto a medium from a liquid ejecting head, there exist liquid ejecting apparatuses including a mounting portion configured to enable a waste liquid container for containing waste liquid discharged from the liquid ejecting head to be attachably and detachably mounted in the mounting portion itself. The mounting portion of such a liquid ejecting apparatus includes a discharge portion for discharging the waste liquid flown from the liquid ejecting head and an apparatus-side connection terminal capable of being electrically connected to a container-side connection terminal included in the waste liquid container. On the other hand, the waste liquid container includes a waste liquid introduction portion and a container-side connection terminal, and in a state in which the waste liquid container is mounted in the mounting portion, the waste liquid introduction portion is capable of introducing the waste liquid discharged from the discharge portion and the container-side connection terminal is electrically connected to the apparatus-side connection terminal (see, for example, JP-A-2012-196799).

By the way, for the waste liquid introduction portion and the container-side connection terminal in the waste liquid container, the waste liquid introduction portion is located in an upper portion of the waste liquid container, while the container-side connection terminal is disposed on a side face and is located at a position lower than the waste liquid introduction portion. Thus, there has been a possibility that, in the case where the waste liquid discharged from the discharge portion of the mounting portion has been adhered to the periphery of the waste liquid introduction portion of the waste liquid container, when the adhered waste liquid drops downward, the dropped waste liquid comes at the container-side connection terminal.

SUMMARY

An advantage of some aspects of the invention is that a waste liquid container that enables the minimization the occurrence of a situation where, when waste liquid having been adhered to a waste liquid introduction portion located in an upper portion drops downward, the dropped waste liquid comes at a container-side connection terminal located in a lower portion and a liquid ejecting apparatus in which such a waste liquid container is attachably and detachably mounted are provided.

According to an aspect of the invention, a waste liquid container configured to be attachably and detachably mounted in a mounting portion including a discharge portion configured to discharge waste liquid flown from a liquid ejecting head, and an apparatus-side connection terminal located at a position lower than the discharge portion includes a first container portion including a waste liquid introduction portion in an upper portion of the first container portion, the waste liquid introduction portion being configured to enable the waste liquid discharged from the discharge portion to be introduced in a state in which the waste liquid container is mounted in the mounting portion; a second container portion disposed below the first container portion in a vertical direction and communicating with the first container portion in the state in which the waste liquid container is mounted in the mounting portion; and a container-side connection terminal electrically connected to the apparatus-side connection terminal in the state in which the waste liquid container is mounted in the mounting portion. Further, in the state in which the waste liquid container is mounted in the mounting portion, in a plan view from above, the second container portion is formed so as to be larger than the first container portion, and in the second container portion, the container-side connection terminal is disposed at a position not overlapping with the first container portion in the vertical direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a waste liquid container and a liquid ejecting apparatus including a mounting portion configured to enable the waste liquid container to be attachably and detachably mounted in the mounting portion itself will be described with reference to the drawings. Note that the liquid ejecting apparatus in the present embodiment is constituted by an ink jet printer that performs printing by ejecting inks, as an example of liquids, onto paper, as an example of a medium. Further, the relevant printer is a printer whose printing method is a so-called serial printing method in which the printing is performed by moving a liquid ejecting head in a main-scanning direction intersecting with a transport direction of the paper.

Moreover, an X-Y-Z coordinate system including X, Y, and Z directions is indicated in each of the figures, and the X, Y, and Z directions are defined as follows. That is, the X direction is a movement direction (the main-scanning direction) of a carriage (a movement object) that moves together with liquid containers which are mounted in the carriage and in which the liquids are contained, and the X direction corresponds to a width direction of the liquid ejecting apparatus. Further, the Y direction is a depth direction of the liquid ejecting apparatus, and corresponds to the transport direction of the paper and an ejection direction of the paper. Further, the Z direction is a vertical direction, and corresponds to a height direction of the liquid ejecting apparatus.

Further, for the Z direction, a vertically upward direction toward the upper side of the apparatus is defined as a +Z direction, and a vertically downward direction toward the lower side of the apparatus is defined as a −Z direction. Further, for the Y direction, as indicated by an arrow outlined by a full line in FIG. 1, a direction in which the paper is ejected from the inside of the apparatus is defined as a +Y direction, and a direction opposite the above ejection direction is defined as a −Y direction. Further, for the X direction, in a left-right direction when the apparatus is viewed from the +Y direction, a direction toward the right side of the apparatus is defined as a −X direction, and a direction toward the left side of the apparatus is defined as a +X direction.

Figure 1:
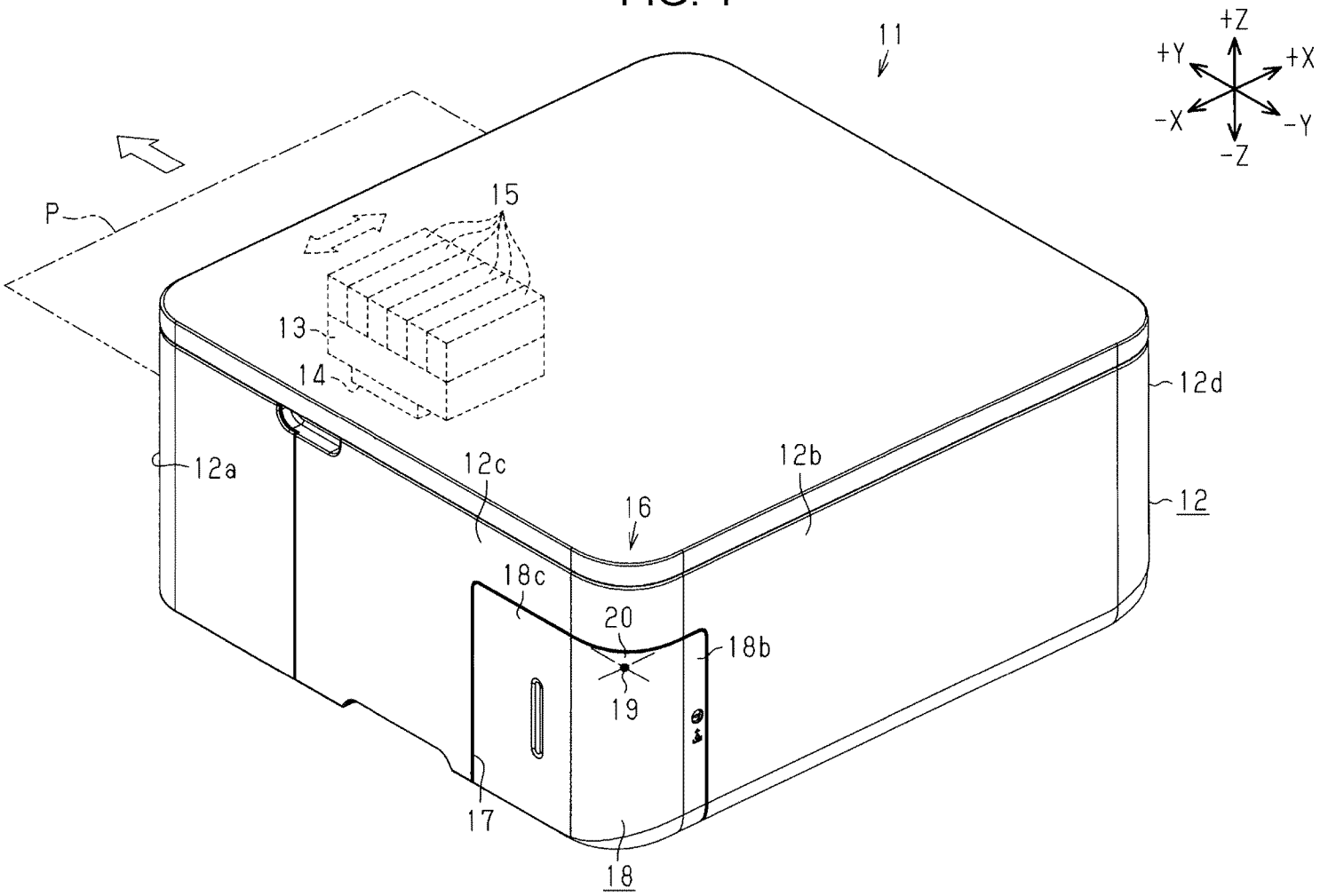
FIG. 1 is a perspective view of a liquid ejecting apparatus, illustrating an external view of the liquid ejecting apparatus.

As illustrated in FIG. 1, a liquid ejecting apparatus 11 includes a housing 12, and this housing 12 has a rectangular solid shape whose long-length direction corresponds to the X direction, which is the width direction of the apparatus. In the inside of the housing 12, a carriage 13 is provided so as to be capable of, as indicated by arrows outlined by a dashed line, reciprocating in the X direction, which is the main-scanning direction, in a region above a transport region in which paper P is transported at the time of the execution of printing. The carriage 13 is formed in a box shape and includes an opening at its +Z direction side, namely at its upper side. In a lower portion of the carriage 13, a liquid ejecting head 14 is mounted, and this liquid ejecting head 14 is capable of ejecting inks (liquids) toward the paper P being transported in the transport region. In an upper portion of the carriage 13, a plurality of (for example, six) liquid containers 15 are mounted so as to be capable of supplying the inks to the liquid ejecting head 14.

The housing 12 includes faces 12*a*, 12*b*, 12*c*, and 12*d*, and in a plan view from above, the face 12*a* is a face located at a +Y direction side at which an ejection port (omitted from illustration) for the paper P is formed; the face 12*b* is a face that is located at a −Y direction side and that, when the face 12*a* is defined as a front face, becomes a rear face opposite the face 12*a*; and the face 12*c* and the face 12*d* form a pair of left and right faces constituting side faces each intersecting with the two faces 12*a* and 12*b*. Further, an opening portion 17 is formed in an intersecting portion 16, and this intersecting portion 16 is a portion in which the −Y direction side face 12*b*, which is the rear face, and the −X direction side face 12*c*, which is one of the pair of left and right faces, namely the faces 12*c* and 12*d*, and which becomes a right side face when the housing 12 is viewed from the +Y direction side, namely the front side, intersect with each other. Further, the opening portion 17 forms a rectangular cut shape in both of a case where the intersecting portion 16 is viewed from the −Y direction side and a case where the intersecting portion 16 is viewed from the −X direction side. That is, the opening portion 17 is formed so as to extend to the −Y direction side face 12*b* and the −X direction side face 12*c* that are among six faces constituting the external face of the housing 12 forming a rectangular solid shape and that are two faces forming the intersecting portion 16 by extending in the Z direction, namely the vertical direction, and intersecting with each other.

Further, a cover 18 is attachably and detachably attached to the opening portion 17. This cover 18 is capable of covering the opening portion 17 when attached to the opening portion 17, and includes faces 18*b* and 18*c*. The face 18*b* is a face along the −Y direction side face 12*b* of the housing 12 in a state in which the cover 18 is attached to the opening portion 17. Similarly, the face 18*c* is a face along the −X direction side face 12*c* of the housing 12 in a state in which the cover 18 is attached to the opening portion 17. That is, when attached to the opening portion 17, the cover 18 allows the face 18*b* and the face 18*c*, which are two faces intersecting with each other, to respectively form one portion of the face 12*b* and one portion of the face 12*c*, these faces 12*b* and 12*c* being two faces intersecting with each other in the intersection portion 16 of the housing 12.

Figure 3:
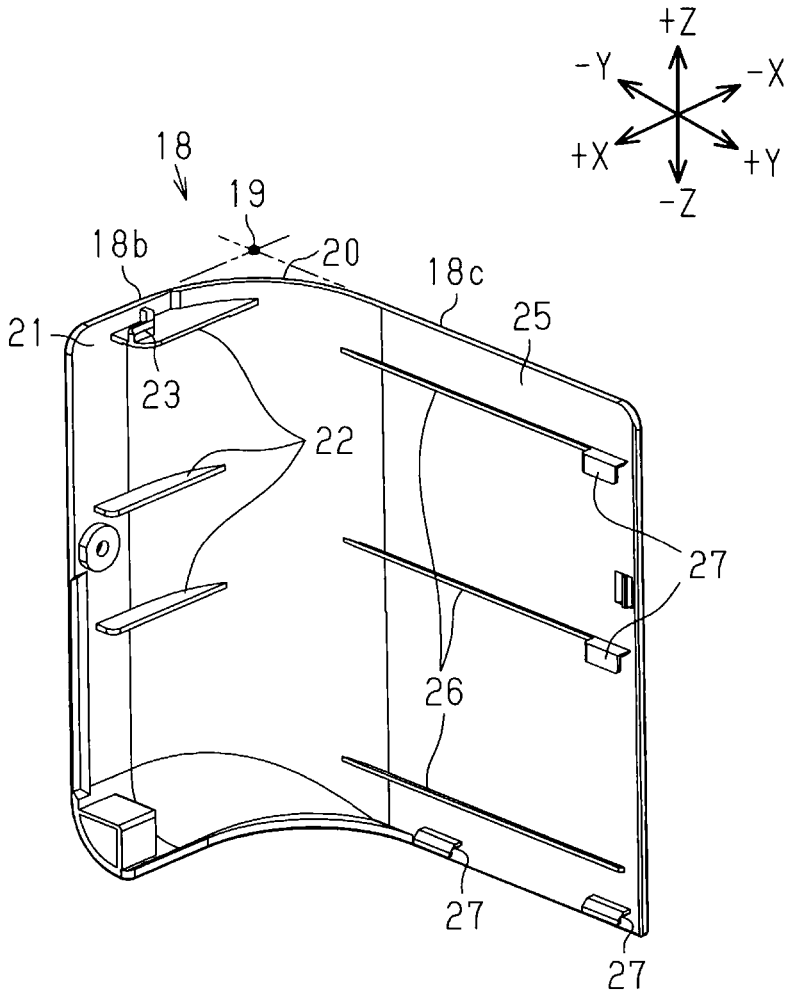
FIG. 3 is a perspective view of the cover, illustrating the reverse side of the cover.

As illustrated in FIGS. 1 and 3, in a state in which the cover 18 is attached to the opening portion 17, the cover 18 includes an interconnecting face 20 at a side at which the opening portion 17 is disposed and which is located further inside than an intersecting point 19. This intersecting point 19 is an intersecting point of the −Y direction side face 12*b* and the −X direction side face 12*c*, namely the two faces intersecting with each other in the intersection portion 16 of the housing 12. The interconnecting face 20 smoothly interconnects the −Y direction side face 18*b* and the −X direction side face 18*c* of the cover 18. That is, the intersecting portion 16 of the housing 12 is formed so as to have an R-shape in a plan view from above, and thus, the interconnecting face 20, which interconnects the −Y direction side face 18*b* and the −X direction side face 18*c* of the cover 18, which intersect with each other in a state in which the cover 18 is attached to the opening portion 17 that is formed in such the intersection portion 16, is also formed so as to have the R-shape in the plan view from above.

As illustrated in FIG. 3, the cover 18 includes a +Y direction side face 21 at the reverse side of the −Y direction side face 18*b* of the cover 18, and on this +Y direction side face 21, a plurality of (three, in the present embodiment) ribs 22 are formed so as to extend in the X direction. On the upper face of a rib 22 being among the three ribs 22 and located closest to the +Z direction side, an engaging claw 23 is formed, and this engaging claw 23 has the function of being engaged in the Y direction. Further, in the opening portion 17 of the housing 12, an engaging portion 24 is formed so as to correspond to the engaging claw 23 at a position through which the engaging claw 23 passes when the cover 18 is attached/detached to/from the opening portion 17. The engaging portion 24 is capable of being engaged with the engaging claw 23 by being elastically deformed.

Further, the cover 18 includes a +X direction side face 25 at the reverse side of the −X direction side face 18*c* of the cover 18, and on this +X direction side face 25, a plurality of (three, in the present embodiment) ribs 26 are formed so as to extend in the Y direction. At the +Y direction-side end portions of two ribs 26 being among the three ribs 26 and located at the +Z direction side, guide claws 27 are formed, and each of these guide claws 27 has a inverted L shape whose −Z direction side portion is open when viewed from the Y direction. Further, at the −Z direction-side end portion of the +X direction side face 25, two similar guide claws 27 are also formed so as to be spaced by a certain distance in the Y direction. Further, in the opening portion 17 of the housing 12, each of guide portions 28 is formed so as to correspond to a corresponding one of the guide claws 27 at a position through which the corresponding guide claw 27 passes when the cover 18 is attached/detached to/from the opening portion 17. Each of the guide portions 28 has a rail-like shape, and thus is engaged with an individually corresponding one of the guide claws 27 so as to guide the corresponding guide claw 27 in the Y direction and restrict its movement in the X direction.

Figure 4:
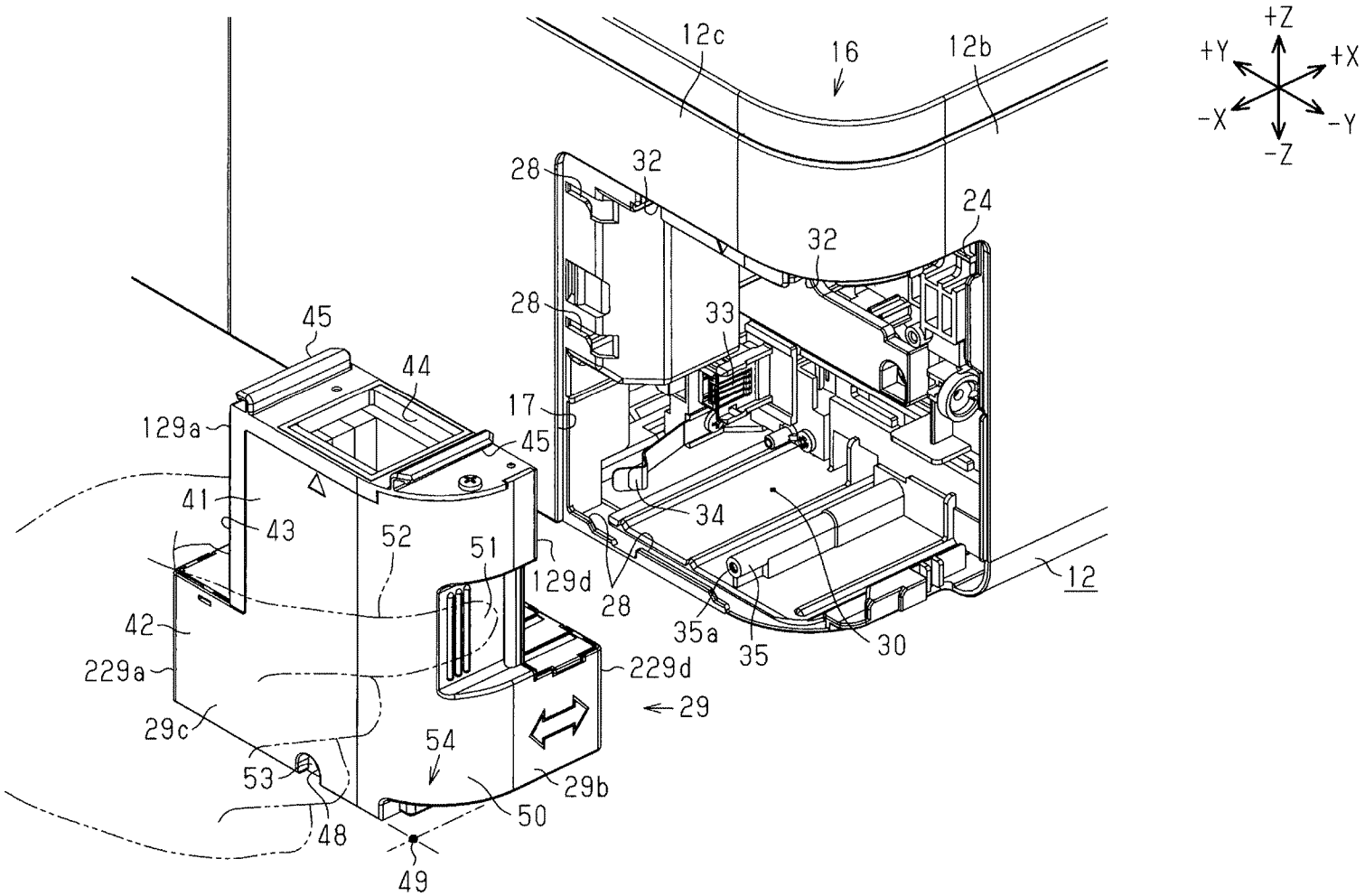
FIG. 4 is a perspective view of one portion of the liquid ejecting apparatus and a waste liquid container in a state in which the waste liquid container is removed from a mounting portion of the liquid ejection apparatus, when the one portion of the liquid ejecting apparatus and the waste liquid container are obliquely viewed from above.
Figure 5:
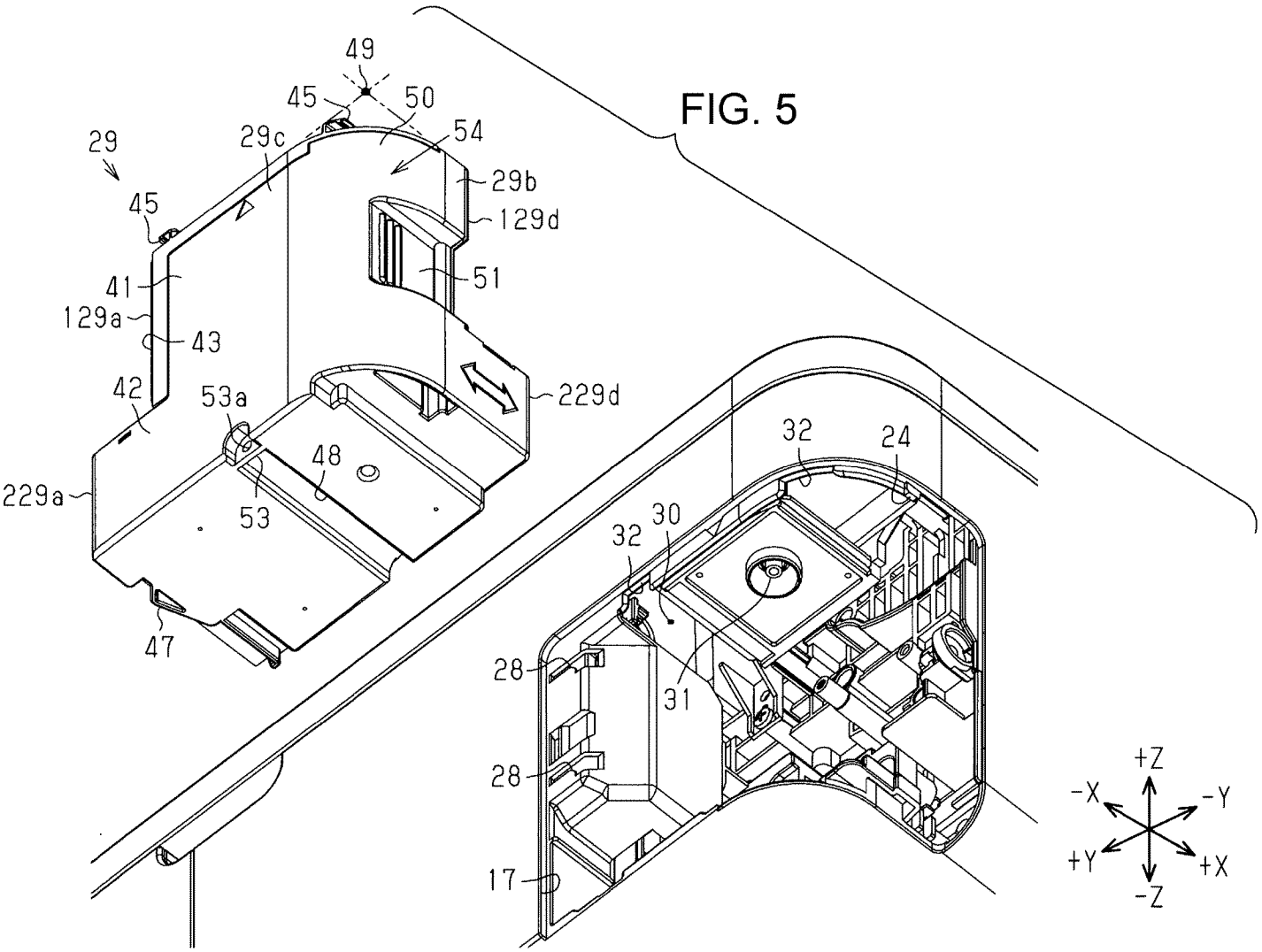
FIG. 5 is a perspective view of the one portion of the liquid ejecting apparatus and the waste liquid container, when the state illustrated in FIG. 4 is obliquely viewed from below.

As illustrated in FIGS. 4 and 5, a mounting portion 30 is disposed inside the opening portion 17 of the housing 12, and in the mounting portion 30, a waste liquid container 29 is attachably and detachably mounted. This liquid container 29 is capable of containing waste liquid. The mounting portion 30 is configured to be exposable to the outside of the housing 12 via the opening portion 17, and is hidden from the outside when the cover 18 is attached to the opening portion 17. Note that FIGS. 4 and 5 illustrate a state in which the cover 18 is removed from the opening portion 17.

As illustrated in FIG. 5, in an upper portion inside the mounting portion 30, a tubular discharge portion 31 is disposed, and this discharge portion 31 is capable of discharging the waste liquid toward the −Z direction. This discharge portion 31 is configured to allow waste liquid to be introduced to the discharge portion 31 itself from an illustration-omitted maintenance portion (for example, a suck cap or the like) in which waste liquid having not been used in printing and having been discharged as waste ink from the liquid ejecting head 14 is received and contained. Further, in the upper portion inside the mounting portion 30, apparatus-side alignment portions 32 are formed, and these alignment portions 32 are capable of being utilized in the alignment at the time when the liquid container 29 is mounted into the mounting portion 30 from the outside of the housing 12 via the opening portion 17. Here, the apparatus-side alignment portions 32 are formed so as to include notches each having a concave shape whose −Z direction side is open, at positions interposing the discharge portion 31 between both Y-direction sides when the mounting portion 30 is viewed from the X direction, which becomes a mounting direction of the liquid container 29 relative to the mounting portion 30.

Further, as illustrated in FIG. 4, in a lower potion inside the mounting portion 30, an apparatus-side connection terminal 33 is disposed at a position located at the +Y direction side and located at the +X direction side. This apparatus-side connection terminal 33 is configured to include an elastically deformable metal fitting or the like. In the inside of the mounting portion 30, the apparatus-side connection terminal 33 is located at a lower position, being located further −Z direction side than the discharge portion 31, and is electrically connected to an illustration-omitted controller provided inside the housing 12. Further, in the lower portion inside the mounting portion 30, an apparatus-side engagement portion 34 is disposed at a position adjacent to and below the apparatus-side connection terminal 33 in the Z direction, which is the vertical direction. This apparatus-side engagement portion 34 includes a sheet metal piece whose +X direction side portion, which is a base edge side portion, extends in the X direction, and whose −X direction side edge portion, which is a leading edge portion, is mountain-folded toward the −Y direction side. That is, the apparatus-side engagement portion 34 is configured to enable its −X direction side portion, which is to be served as its free edge, to be elastically deformed in the Y direction. Moreover, in the lower portion inside the mounting portion 30, a tubular apparatus-side attachment portion 35 is disposed so as to extend in the X direction, at a position located further −Y direction side than the apparatus-side engagement portion 34 and located at an approximately central position in the mounting portion 30. The apparatus-side attachment portion 35 includes, at its front edge, an internal thread hole 35*a*.

Next, the waste liquid container 29, which is attachably and detachably mounted relative to the mounting portion 30, will be described.

Figure 6:
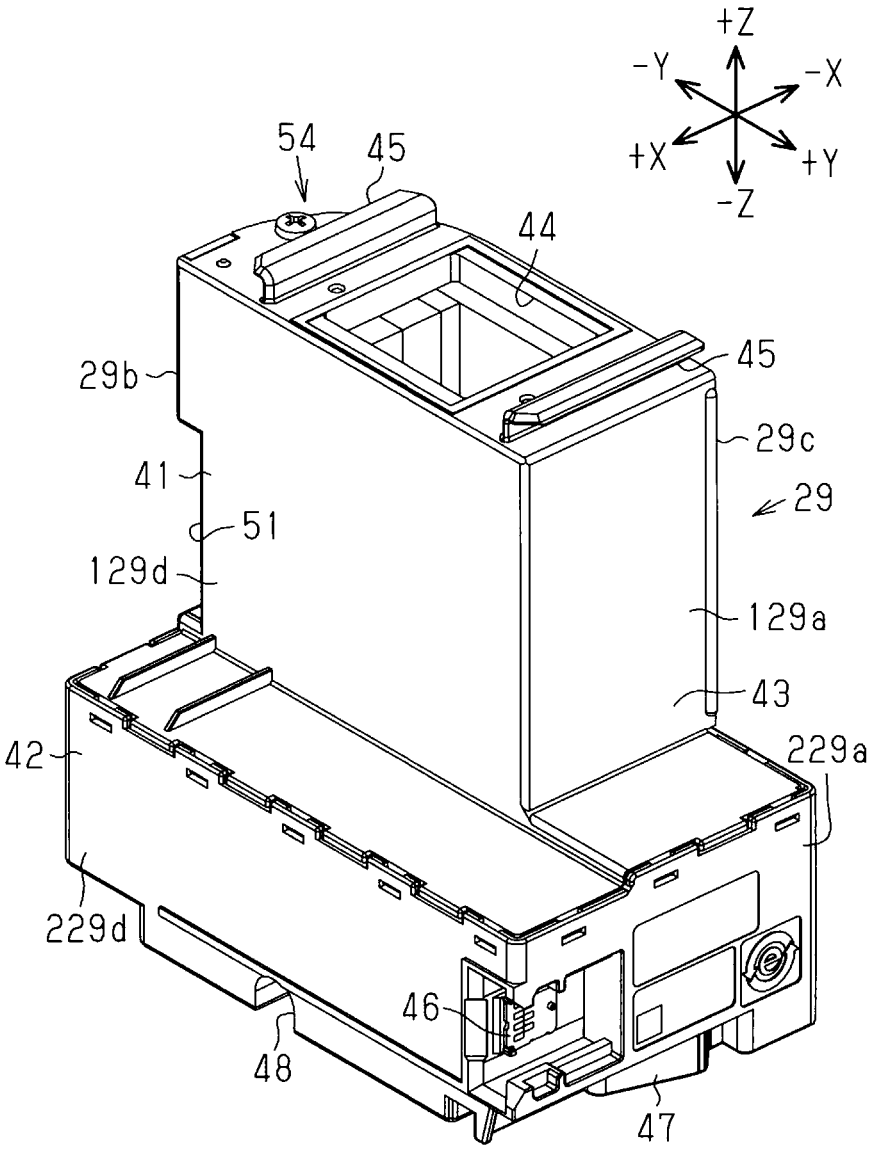
FIG. 6 is a perspective view of the waste liquid container, when the waste liquid container is obliquely viewed from above.
Figure 7:
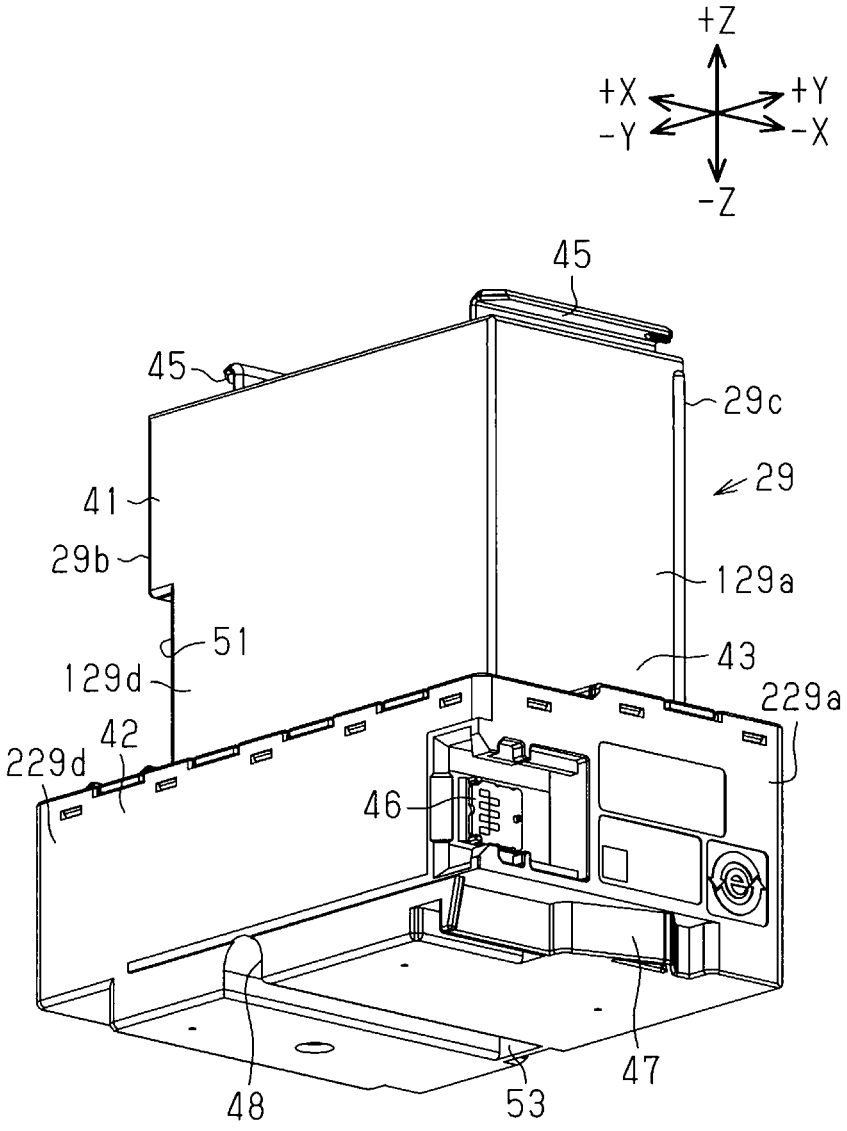
FIG. 7 is a perspective view of the waste liquid container, when the waste liquid container is obliquely viewed from below.

As illustrated in FIGS. 6 and 7, the waste liquid container 29 forms an approximately rectangular shape in a plan view from above, and includes, in its inside, a waste liquid containing chamber (omitted from illustration) capable of containing the waste liquid. The waste liquid container 29 includes a first container portion 41 and a second container portion 42. This first container portion 41 is located at the +Z direction side in the Z direction. The second container portion 42 is located further −Z direction side than the first container portion 41, and is configured to allow the waste liquid containing chamber inside the second container portion 42 to communicate with the first container portion 41. Further, in the waste liquid container 29, a portion located at the +Y direction side and the +X direction side of the waste liquid container 29 and located further +Z direction side than the second container portion 42 is configured to form a step portion 43. This step portion 43 forms an approximately L-letter shape in a plan view from above. Thus, because of the existence of the step portion 43, the second container portion 42 is formed so as to be larger than the first container portion 41 in a plan view from above.

As illustrated in FIGS. 4 and 6, among four-direction side faces of the waste liquid container 29, a −Y direction side face 29*b* and a −X direction side face 29*c* are common to the first container portion 41 and the second container portion 42, but a +Y direction side face and a +X direction side face are not common to the first container portion 41 and the second container portion 42. That is, the +Y direction side face is separated into a +Y direction side face 129*a* of the first container portion 41 and a +Y direction side face 229*a* of the second container portion 42, and the +X direction side face is separated into a +X direction side face 129*d* of the first container portion 41 and a +X direction side face 229*d* of the second container portion 42. Further, because of the existence of the step portion 43, the +Y direction side face 129*a* of the first container portion 41 is position-shifted to the −Y direction side from the +Y direction side face 229*a* of the second container portion 42, and the +X direction side face 129*d* of the first container portion 41 is position-shifted to the −X direction side from the +X direction side face 229*d* of the second container portion 42.

On the upper face of the first container portion 41 in the liquid container 29, a waste liquid introduction portion 44 is formed, and this waste liquid introduction portion 44 includes an opening extending toward the +Z direction, which is an upwardly extending direction. The waste liquid introduction portion 44 communicates with the waste liquid containing chamber inside the waste liquid container 29. Further, in a state in which the waste liquid container 29 is mounted in the mounting portion 30, the waste liquid introduction portion 44 is configured to allow its position to overlap with that of the discharge portion 31 in the Z direction, which is located in the upper portion inside the mounting portion 30, and thereby to be capable of introducing the waste liquid having been discharged from the discharge portion 31 into the waste liquid containing chamber.

Further, on the upper face of the first container portion 41 of the waste liquid container 29, a pair of container-side alignment portions 45 is disposed so as to extend in the X direction. When the waste liquid container 29 is mounted into the mounting portion 30, the pair of container-side alignment portions 45 is allowed to be aligned with and inserted into the pair of apparatus-side alignment portions 32, which is provided in the upper portion inside the mounting portion 30. The waste liquid container 29 is configured to, when mounted into the mounting portion 30, allow the X direction to be the mounting direction, and in the Y direction intersecting with the X direction, which is the mounting direction of the waste liquid container 29, the pair of container-side alignment portions 45 is formed at positions interposing the waste liquid introduction portion 44 between both Y-direction sides.

Further, as illustrated in FIGS. 6 and 7, on the +Y direction side face 229*a*, which is one side face of the second container portion 42 of the waste liquid container 29, a container-side connection terminal 46 is disposed, and this container-side connection terminal 46 is brought into contact with and electrically connected to the apparatus-side connection terminal 33, which is disposed inside the mounting portion 30, when the waste liquid container 29 is mounted into the mounting portion 30. In the waste liquid container 29, the container-side connection terminal 46 is disposed on the +Y direction side face 229*a* of the second container portion 42, the position of the +Y direction side face 229*a* being shifted to a +Y direction side position further outside than the +Y direction side face 129*a* of the first container portion 41, on the upper face of which the waste liquid introduction portion 44 is disposed. Thus, the container-side connection terminal 46 is disposed at a position not overlapping with the first container portion 41 in the Z direction, which is the vertical direction, in a plan view from above.

Further, as illustrated in FIGS. 6 and 7, on the +Y direction side face 229*a* of the second container portion 42, a container-side engagement portion 47 is disposed at a position below and adjacent to the container-side connection terminal 46 in the Z direction, and this container-side engagement portion 47 is engaged with the apparatus-side engagement portion 34 when the waste liquid container 29 is mounted in the mounting portion 30. The container-side engagement portion 47 is configured to allow its +X direction side portion being an anterior-side portion in the mounting direction of the waste liquid container 29 relative to the mounting portion 30 to be a guide face extending in the X direction, and to allow its −X direction side portion being a posterior-side portion in the mounting direction of the waste liquid container 29 to form a shape in which, after an upward inclination toward the +Y direction side is formed, a valley shape is formed toward the −Y direction side. That is, in the apparatus-side engagement portion 34, the leading edge portion, which is mountain-folded toward the −Y direction side, is configured to be engaged while regulating the movement in the X direction along with the elastic deformation in the Y direction.

Moreover, on the lower face of the second container portion 42 in the waste liquid container 29, a groove portion 48 is formed so as to extend in the X direction. This groove portion 48 has a semicircle-shaped cross section, and enables the apparatus-side attachment portion 35 to be inserted when the waste liquid container 29 is mounted into the mounting portion 30. As illustrated in FIG. 5, in the groove portion 48, a container-side attachment portion 53 is formed in a −X direction side end portion being a posterior side portion in the mounting direction of the waste liquid container 29 relative to the mounting portion 30, and this container-side attachment portion 53 is formed in a wall shape, and includes a penetration hole 53*a*. That is, in a state in which the tubular apparatus-side attachment portion 35 is inserted in the groove portion 48, a screw member (omitted from illustration) having been inserted through the penetration hole 53*a* of the container-side attachment portion 53 is screwed together with the internal thread hole 35*a* formed at the front edge of the apparatus-side attachment portion 35 to secure the waste liquid container 29 to the mounting portion 30.

Figure 2:
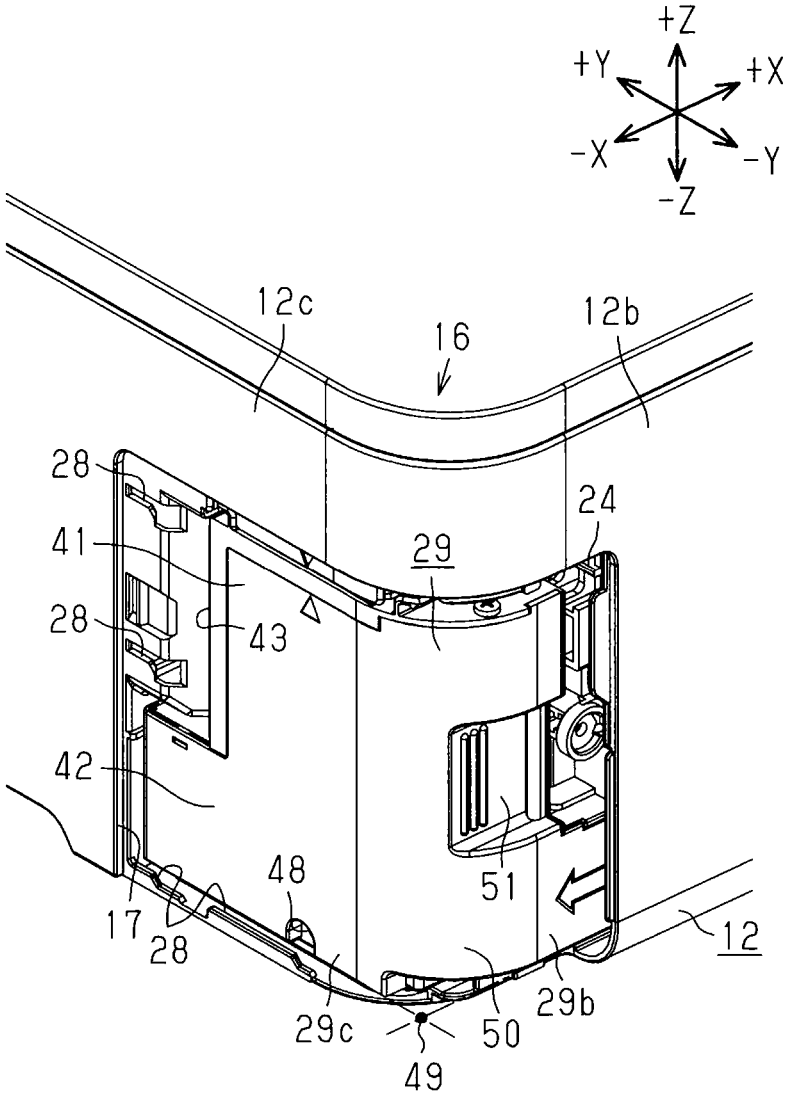
FIG. 2 is a perspective view of the liquid ejecting apparatus with its cover removed.

As illustrated in FIGS. 2, 4, and 5, in the waste liquid container 29, the −Y direction side face 29*b* and the −X direction side face 29*c*, which are exposed to the outside via the opening portion 17 when the waste liquid container 29 is mounted in the mounting portion 30, intersect with each other in an intersecting portion 54, and this intersecting portion 54 is formed so as to form an R-shape in a plan view from above. That is, in the intersecting portion 54, in which the −Y direction side face 29*b* and the −X direction side face 29*c* of the waste liquid container 29 intersect with each other, an interconnecting face 50 is disposed, and this interconnecting face 50 smoothly interconnects the −Y direction side face 29*b* and the −X direction side face 29*c* at a side at which the waste liquid introduction portion 44 is disposed and which is located further inside than an intersecting point 49, namely an intersecting point of the −Y direction side face 29*b* and the −X direction side face 29*c*.

Further, on the −Y direction side face 29*b* of the waste liquid container 29, a concave portion 51 is formed, and this concave portion 51 extends across the +X direction side face 129*d* and the interconnecting face 50 in the first container portion 41. Thus, as illustrated in FIG. 4, when a user mounts the waste liquid container 29 into the mounting portion 30, the user is able to easily grasp and hold the waste liquid container 29 by holding the concave portion 51 and the step portion 43 in the waste liquid container 29 with fingertips 52 of the user.

Next, the operation of the waste liquid container 29 and the liquid ejecting apparatus 11 that are configured in such a way as described above will be described focusing attention on a case where the waste liquid container 29 is attached/detached to/from the mounting portion 30 included in the liquid ejecting apparatus 11.

When the waste liquid container 29 is mounted into the mounting portion 30 of the housing 12, at first, the cover 18 is removed from the opening portion 17 of the housing 12. At this time, since the cover 18 includes the interconnecting face 20, which smoothly interconnects the −Y direction side face 18*b* and the −X direction side face 18*c* at a side located further inside than the interconnecting point 19 of these faces, a user's operation of holding the interconnecting face 20 with the user's fingertips facilitates the user's operation of attaching/detaching the cover 18 to/from the opening portion 17.

Upon removal of the cover 18 from the opening portion 17, the mounting portion 30 is exposed to the outside via the opening portion 17. In such a state, next, the waste liquid container 29 is grasped and held, and then is mounted into the mounting portion 30. At this time, the waste liquid container 29 includes the interconnecting face 50, which smoothly interconnects the −Y direction side face 29*b* and the −X direction side face 29*c* at a side further inside than the intersecting point 49 of both of these faces, and thus, a user's operation of holding the interconnecting face 50 with the user's fingertips facilitates the user's operation of holding the waste liquid container 29. Thus, it is unnecessary to particularly form a holding portion in the waste liquid container 29 in such a way as to allow the holding portion to protrude.

Further, when the waste liquid container 29 is mounted into the mounting portion 30, the container-side alignment portions 45 are aligned with the apparatus-side alignment portions 32, and thus, this configuration enables the waste liquid introduction portion 44 to be mounted into the discharge portion 31 without any misalignment. Further, from a state in which the alignment has been made in such a way as described above, the waste liquid container 29 is brought into a mounted state by being moved in the X direction, which is one direction in which the apparatus-side attachment portion 35 extends.

Further, at the time of the execution of the mounting, the container-side connection terminal 46 and the apparatus-side connection terminal 33 are brought into an electrically stable connection state because the container-side engagement portion 47 and the apparatus-side engagement portion 34, which are respectively disposed at a position adjacent to the container-side connection terminal 46 and a position adjacent to the apparatus-side connection terminal 33 in the Z direction, are engaged with each other. Further, in the mounted state, the waste liquid having been discharged from the discharge portion 31 is introduced into the waste liquid containing chamber of the waste liquid container 29 via the waste liquid introduction portion 44, and is contained therein. At this time, even when the waste liquid from the periphery of the waste liquid introduction portion 44 travels on a side face of the first container portion 41, such as the +X direction side face 129*d*, and drops down, the flow-around of such the dropped liquid is minimized because the +X direction side face 229*d*, which is, in the second container portion 42, a side face on which the container-side connection terminal 46 is disposed, is configured not to overlap with the +X direction side face 129*d* of the first container portion 41 in the Z direction.

According to the above embodiment, the following advantageous effects are brought about.

(1) Even when the waste liquid having been discharged from the discharge portion 31 of the mounting portion 30 is adhered to the periphery of the waste liquid introduction portion 44, located in an upper portion of the waste liquid container 29, and further, the adhered waste liquid drops downward, the occurrence of a situation where the dropped waste liquid comes at the container-side connection terminal 46, located in a lower portion of the waste liquid container 29, is minimized because, in the second container portion 42, the container-side connection terminal 46 is located at a position not overlapping with the first container portion 41 in the Z direction.

(2) Even when the waste liquid having been adhered to the periphery of the waste liquid introduction portion 44 travels on the +X direction side face 129*d* of the first container portion 41, and drops down, the flow-around of the dropped waste liquid to the container-side connection terminal 46 is minimized because the +X direction side face 229*d*, on which the container-side connection terminal 46 is disposed, is located further outside than the +X direction side face 129*d* of the first container portion 41 in the second container portion 42.

(3) The container-side engaged portion 47 is engaged with the apparatus-side engagement portion 34 at a position close to the container-side connection terminal 46, and thus, the container-side connection terminal 46 is correctly connected to the apparatus-side connection terminal 33.

(4) When the waste liquid container 29 is mounted into the mounting portion 30, the position of the waste liquid introduction portion 44 can be aligned with that of the discharge portion 31 using the apparatus-side alignment portion 32 and the container-side alignment portion 45, and thus, the occurrence of a situation where the waste liquid having been discharged from the discharge portion 31 is improperly adhered to the periphery of the waste liquid introduction portion 44 is minimized.

(5) When the fingertips 52 are placed on the interconnecting portion 50 of the waste liquid container 29, the waste liquid container 29 can be grasped and held in such a way as to allow the fingertips 52 to be crossed over the intersecting portion 54, in which the −Y direction side face 29*b* and the −X direction side face 29*c* intersects with each other, and thus, for the waste liquid container 29, it is unnecessary to separately form a holding portion in such a way as to allow the holding portion to protrude to enable the holding portion to be held with the fingertips 52. Further, as compared with such a configuration in which a holding portion is separately formed so as to protrude from the waste liquid container 29, the above-described configuration according the present embodiment enables a capacity appropriated by the waste liquid container 29 itself to be largely secured inside the mounting portion 30, and thus, enables a large amount of waste liquid to be contained.

(6) When the waste liquid container 29 is attached/detached to/from the mounting portion 30, the waste liquid container 29 can be grasped and held over the −Y direction side face 12*b* and the −X direction side face 12*c*, which are two faces of the housing 12 that intersect with each other via the opening portion 17, and thus, this configuration facilitates the operation of attaching/detaching the waste liquid container 29.

(7) When the opening portion 17 is covered by the cover 18, the cover 18 not only blocks the waste liquid container 29 mounted in the mounting portion 30 from being improperly touched by a user, but also keeps the external view of the liquid ejecting apparatus 11 in a favorable state.

(8) When fingertips are placed on the interconnecting face 20, the cover 18 can be grasped and held in such a way as to allow the fingertips to be crossed over the intersecting portion, in which the −Y direction side face 18*b* and the −X direction side face 18*c* intersects with each other, and thus, this configuration facilitates the attachment and the detachment of the cover 18 to the opening portion 17 of the housing 12.

(9) When the waste liquid container 29 is mounted into the mounting portion 30, the attachment and the detachment of the waste liquid container 29 is enabled by moving the waste liquid container 29 only in the X direction, namely only in one direction, relative to the mounting portion 30.

Note that the above-described embodiment may be modified in such ways as described in modification examples below. Further, any configuration included in the above-described embodiment may be optionally combined with any configuration included in modification examples described below, and any configurations included in modification examples described below may be optionally combined with one another.

The waste liquid container 29 may be attached/detached to/from the mounting portion 30 via the opening portion 17 in the Y direction, which is another one of the directions that is different from the X direction, that is, not to/from the side at which the −X direction side face 12*c* is located, but to/from the side at which the −Y direction side face 12*b* is located. In this case, the apparatus-side connection terminal 33, the apparatus-side engagement portion 34, the apparatus-side attachment portion 35, the container-side connection terminal 46, the container-side engagement portion 47, and the groove portion 48 are disposed so as to extend, not in the X direction, but in the Y direction.

The cover 18 may be configured to be secured to the housing 12 with screws.

The cover 18, which is capable of covering the opening portion 17, may not be installed. In this case, the −Y direction side face 29*b* and the −X direction side face 29*c* of the waste liquid container 29 having been mounted in the mounting portion 30 via the opening portion 17 are configured to respectively form one portion of the −Y direction side face 12*b* and one portion of the −X direction side face 12*c* of the housing 12.

In the case where the cover 18, which is capable of covering the opening portion 17, is not provided, the waste liquid container 29 may be configured in a shape protruding toward the outside from the opening portion 17. This configuration enables the increase of the amount of containable waste liquid.

The opening portion 17, which allows the mounting portion 30 to be exposed to the outside, may be configured such that the opening portion 17 is not constituted as such the opening extending to the two faces intersecting with each other, but is constituted as an opening formed on one face, such as the −X direction side face 12*c*, in the housing 12.

The interconnecting face 50 of the intersecting portion 54, in which the −Y direction side face 29*b* and the −X direction side face 29*c* of the waste liquid container 29 intersects with each other, may be configured such that, in a plan view above, the interconnecting face 50 does not form the smooth R shape, but forms the shape of a continuous folded-line passing through a region further inside than the intersecting point 49.

The intersecting portion 54 of the −Y direction side face 29*b* and the −X direction side face 29*c* of the waste liquid container 29 may be configured such that these faces are not interconnected by the smooth interconnecting face 50, but orthogonally intersect and are joined each other, or have a chamfered shape.

Each of the number of the apparatus-side alignment portions 32 and the number of the container-side alignment portions 45 may be, not the pair, but just one, or three or more. Further, such an alignment portion is not necessary in both of the apparatus side and the container side.

In the waste liquid container 29, the container-side connection terminal 46, which is disposed at a position lower than the waste liquid introduction portion 44, may be disposed, not on the side face of the second container portion 42, but on an upper face of the second container portion 42, which forms the step portion 43 between the first container portion 41 and the second container portion 42.

The waste liquid container 29 may be configured in a shape other than the rectangular shape, for example, a circular shape or the like, in a plan view from above, provided that the second container portion 42 is formed so as to be larger than the first container portion 41 in the plan view from above.

In the waste liquid container 29, the interconnecting portion 50, which smoothly interconnects the −Y direction side face 29*b* and the −X direction side face 29*c* at a side further inside than the intersecting point 49 in the intersecting portion 54 of the −Y direction side face 29*b* and the −X direction side face 29*c*, may be formed only in the first container portion 41 or only in the second container portion 42.

The apparatus-side engagement portion 34 and the container-side engagement portion 47 may be configured such that the container-side engagement portion 47 is constituted by an elastically deformable sheet metal piece and the apparatus-side engagement portion 34 is not deformed, or both of these portions may be configured to be elastically deformed and engaged with each other by energizing forces.

Hereinafter, technical Ideas grasped from the aforementioned embodiment and modification examples as well as operational advantages of the technical Ideas will be described.

Technical Idea 1

According to technical Idea 1, a waste liquid container configured to be attachably and detachably mounted in a mounting portion including a discharge portion configured to discharge waste liquid flown from a liquid ejecting head, and an apparatus-side connection terminal located at a position lower than the discharge portion includes a first container portion including a waste liquid introduction portion in an upper portion of the first container portion, the waste liquid introduction portion being configured to enable the waste liquid discharged from the discharge portion to be introduced in a state in which the waste liquid container is mounted in the mounting portion; a second container portion disposed below the first container portion in a vertical direction and communicating with the first container portion in the state in which the waste liquid container is mounted in the mounting portion; and a container-side connection terminal electrically connected to the apparatus-side connection terminal in the state in which the waste liquid container is mounted in the mounting portion. Further, in the state in which the waste liquid container is mounted in the mounting portion, in a plan view from above, the second container portion is formed to be larger than the first container portion, and in the second container portion, the container-side connection terminal is disposed at a position not overlapping with the first container portion in the vertical direction.

According to this configuration, even when the waste liquid discharged from the discharge portion of the mounting portion has been adhered to the periphery of the waste liquid introduction portion, located in an upper portion of the waste liquid container, and the adhered waste liquid drops downward, the occurrence of a situation where the dropped waste liquid comes at the apparatus-side connection terminal, located in a lower portion of the waste liquid container, is minimized.

Technical Idea 2

In the waste liquid container according to technical Idea 1, in the state in which the waste liquid container is mounted in the mounting portion, the waste liquid introduction portion is disposed on an upper face of the first container portion, and the container-side connection terminal is disposed on a side face of the second container portion.

According to this configuration, when the waste liquid having been adhered to the periphery of the waste liquid introduction portion drops down, the flow-around of the dropped waste liquid to the container-side connection terminal is minimized.

Technical Idea 3

In the waste liquid container according to technical Idea 1 or technical Idea 2, the second container portion includes a container-side engagement portion at a position adjacent to the container-side connection terminal in the vertical direction, and in a state in which the container-side connection terminal is electrically connected to the apparatus-side connection terminal, the container-side engagement portion is engaged with an apparatus-side engagement portion disposed in the mounting portion.

According to this configuration, the container-side engagement portion is engaged with the apparatus-side engagement portion at a position close to the container-side connection terminal, and thus, the container-side connection terminal is correctly connected to the apparatus-side connection terminal.

Technical Idea 4

In the waste liquid container according to any one of technical Ideas 1 to 3, the first container portion includes a pair of container-side alignment portions disposed at positions interposing the waste liquid introduction portion in a direction intersecting with a mounting direction toward the mounting portion, and when the waste liquid container is mounted into the mounting portion, the container-side alignment portions are allowed to be aligned with apparatus-side alignment portions disposed at positions interposing the discharge portion when the mounting portion is viewed from the mounting direction.

According to this configuration, when the waste liquid container is mounted into the mounting portion, the position of the waste liquid introduction portion can be aligned with that of the mounting portion, and thus, the adherence of the waste liquid to the periphery of the waste liquid introduction portion is minimized.

Technical Idea 5

In the waste liquid container according to any one of technical Ideas 1 to 4, in a state in which the waste liquid container is mounted in the mounting portion, at least one of the first container portion and the second container portion includes two faces that extend in the vertical direction in a state of intersecting with each other, and in an intersecting portion in which the two faces intersect with each other, an interconnecting face that interconnects the two faces is disposed at a side at which the waste liquid introduction portion is disposed and that is located further inside than an intersecting point of the two faces.

According to this configuration, when fingertips are placed on the interconnecting face, the waste liquid container can be grasped and held in such a way as to allow the fingertips to be crossed over the intersecting portion, in which the two faces intersect with each other, and thus, for the waste liquid container, it is unnecessary to separately form a holding portion in such a way as to allow the holding portion to protrude to enable the waste liquid container to be held with the fingertips. Further, as compared with such a configuration in which a holding portion is formed so as to protrude from the waste liquid container, the above-described configuration enables a capacity appropriated by the waste liquid container itself to be largely secured inside the mounting portion, and thus, enables a large amount of waste liquid to be contained.

Technical Idea 6

According to technical Idea 6, a liquid ejecting apparatus includes a liquid ejecting head configured to eject liquid, a discharge portion configured to discharge waste liquid flown from the liquid ejecting head, an apparatus-side connection terminal located lower than the discharge portion, and a mounting portion in which the waste liquid container according to any one of technical Ideas 1 to 5 is attachably and detachably mounted.

According to this configuration, in the liquid ejecting apparatus, the occurrence of a situation where the waste liquid having been adhered to the periphery of the waste liquid container mounted in the mounting portion comes at the apparatus-side connection terminal of the mounting portion via the container-side connection terminal is minimized.

Technical Idea 7

According to technical Idea 7, a liquid ejecting apparatus includes a liquid ejecting head configured to eject liquid, a mounting portion which includes a discharge portion configured to discharge waste liquid flown from the liquid ejecting head and in which a waste liquid container configured to contain the waste liquid discharged from the discharge portion is attachably and detachably mounted, and a housing including the liquid ejecting head and an opening portion configured to enable the mounting portion to be externally exposed. Further, the opening portion is disposed to extend to two faces intersecting with each other among faces constituting an external face of the housing.

According to this configuration, when the waste liquid container is attached/detached to/from the mounting portion, the waste liquid container can be grasped and held over the two faces, which intersect with each other via the opening portion, and thus, this configuration facilitates the operation of attaching/detaching the waste liquid container.

Technical Idea 8

The liquid ejecting apparatus according to technical Idea 7 further includes a cover being attachable and detachable to the opening potion and configured to cover the opening portion when the cover is attached to the opening portion, and the cover forms one portion of the two faces of the housing when the cover is attached to the opening portion.

According to this configuration, when the opening portion is covered by the cover, the cover not only blocks the waste liquid container mounted in the mounting portion from being improperly touched by a user, but also keeps the external view of the liquid ejecting apparatus in a favorable state.

Technical Idea 9

In the liquid ejecting apparatus according to technical Idea 8, in a portion corresponding to an intersecting portion in which the two faces of the housing intersects with each other in a state in which the cover is attached to the opening portion, the cover includes an interconnecting face that interconnects the two faces at a side at which the opening portion is disposed and that is located further inside than an intersecting point of the two faces in a plan view from above.

According to this configuration, when fingertips are placed on the interconnecting face, the cover can be grasped and held in such a way as to allow the fingertips to be crossed over the intersecting portion, in which the two faces intersect with each other, and thus, this configuration facilitates the attachment and the detachment of the cover to the opening portion.

Technical Idea 10

In the liquid ejecting apparatus according to any one of technical Ideas 7 to 9, the mounting portion is configured to enable the waste liquid container to be attached/detached to/from a side at which one of the two faces is located.

According to this configuration, the attachment and the detachment of the waste liquid container is enabled by moving the waste liquid container only in one direction relative to the mounting portion.

The entire disclosure of Japanese Patent Application No. 2017-107704, filed May 31, 2017 is expressly incorporated by reference herein.

What is claimed is:

1. A waste liquid container configured to be attachably and detachably mounted in a mounting portion including a discharge portion configured to discharge waste liquid flown from a liquid ejecting head, and an apparatus-side connection terminal located at a position lower than the discharge portion, the waste liquid container comprising:

a first container portion including a waste liquid introduction portion in an upper portion of the first container portion, the waste liquid introduction portion being configured to enable the waste liquid discharged from the discharge portion to be introduced in a state in which the waste liquid container is mounted in the mounting portion;

a second container portion disposed below the first container portion in a vertical direction and communicating with the first container portion in the state in which the waste liquid container is mounted in the mounting portion; and a container-side connection terminal electrically connected to the apparatus-side connection terminal in the state in which the waste liquid container is mounted in the mounting portion, wherein, in the state in which the waste liquid container is mounted in the mounting portion, in a plan view from above, the second container portion is formed to be larger than the first container portion, and in the second container portion, the container-side connection terminal is disposed at a position not overlapping with the first container portion in the vertical direction.

2. The waste liquid container according to claim 1, wherein, in the state in which the waste liquid container is mounted in the mounting portion, the waste liquid introduction portion is disposed on an upper face of the first container portion, and the container-side connection terminal is disposed on a side face of the second container portion.

3. The waste liquid container according to claim 1, wherein the second container portion includes a container-side engagement portion at a position adjacent to the container-side connection terminal in the vertical direction, and in a state in which the container-side connection terminal is electrically connected to the apparatus-side connection terminal, the container-side engagement portion is engaged with an apparatus-side engagement portion disposed in the mounting portion.

4. The waste liquid container according to claim 1, wherein the first container portion includes a pair of container-side alignment portions disposed at positions interposing the waste liquid introduction portion in a direction intersecting with a mounting direction toward the mounting portion, and when the waste liquid container is mounted into the mounting portion, the container-side alignment portions are allowed to be aligned with apparatus-side alignment portions disposed at positions interposing the discharge portion when the mounting portion is viewed from the mounting direction.

5. The waste liquid container according to claim 1, wherein, in a state in which the waste liquid container is mounted in the mounting portion, at least one of the first container portion and the second container portion includes two faces that extend in the vertical direction in a state of intersecting with each other, and in an intersecting portion in which the two faces intersect with each other, an interconnecting face that interconnects the two faces is disposed at a side at which the waste liquid introduction portion is disposed and that is located further inside than an intersecting point of the two faces in a plan view from above.

6. A liquid ejecting apparatus comprising:

a liquid ejecting head configured to eject liquid;

a discharge portion configured to discharge waste liquid flown from the liquid ejecting head;

an apparatus-side connection terminal located lower than the discharge portion; and a mounting portion in which the waste liquid container according to claim 1 is attachably and detachably mounted.

* * * * *